US005548384A

United States Patent [19]

Weed

[11] Patent Number: 5,548,384

[45] Date of Patent: Aug. 20, 1996

[54] TONER SUPPLY CARTRIDGE

[75] Inventor: John M. Weed, Murrysville, Pa.

[73] Assignee: International Communications Materials, Inc., Connellsville, Pa.

[21] Appl. No.: 417,954

[22] Filed: Apr. 6, 1995

[51] Int. Cl.[6] ..... G03G 15/08

[52] U.S. Cl. ..... 355/260; 141/364; 222/DIG. 1; 414/411

[58] Field of Search ..... 355/260; 141/364; 414/411; 222/DIG. 1

[56] References Cited

U.S. PATENT DOCUMENTS

| | | | |
|---|---|---|---|
| 3,337,072 | 8/1967 | Del Vechio et al. | 214/304 |
| 4,091,765 | 5/1978 | Lowthorp et al. | 118/658 |
| 4,688,926 | 8/1987 | Manno | 355/3 DD |
| 5,030,997 | 7/1991 | Michlin et al. | 355/260 |
| 5,118,013 | 6/1992 | Mutou et al. | 222/171 |
| 5,235,389 | 10/1993 | Kikuchi et al. | 355/260 |

FOREIGN PATENT DOCUMENTS

| | | | |
|---|---|---|---|
| 0483440 | 5/1992 | European Pat. Off. | 355/260 |

*Primary Examiner*—Joan H. Pendegrass
*Attorney, Agent, or Firm*—Reed Smith Shaw & McClay

[57] ABSTRACT

The present invention relates to apparatus for dispensing toner comprising a generally cylindrical container for containing a quantity of toner, at least one end aperture and at least one toner discharge opening formed therein, a first closure detachably, rotatably and sealingly secured to the cylindrical container for closing the end aperture, a shutter member extending from the first closure for selectively opening and closing the toner discharge opening of the cylindrical container when the first closure is rotated, and means for aligning the dispensing apparatus.

9 Claims, 4 Drawing Sheets

10
12
16
18
22
26
28
32
34
36
37
40
42
52
54
55
56
58a
58b
60
61
62
63
64
65
66
67
68
69
70
71
72
73
74
76
6
7

TONER SUPPLY CARTRIDGE

FIELD OF THE INVENTION

The present invention relates to an apparatus for dispensing particulate matter, such as a toner powder, into an electrophotographic type reproduction machine, or the like, and more particularly relates to a dispensing apparatus that operates to dispense a desired amount of toner into electrophotographic type reproduction machines.

BACKGROUND OF THE INVENTION

In typical electrophotographic type reproduction machines, during the course of each operating cycle, latent electrostatic images of the subject matter being reproduced are generated on a moving recording member. This recording member typically comprises a layer of photoconductive insulating material on a conductive backing, is given a uniform electric charge over its surface and is then exposed to the subject matter to be reproduced, usually by conventional projection techniques. This exposure creates an electrostatic latent image on the coating on the recording member. Following exposure, the latent electrostatic images on the recording member are developed at a developing station through the use of a developer mixture. In electrophotographic type reproduction machines that use dry developers for developing electrostatic images, the typically employed developer mixture includes a toner material and a carrier material. The developed image is then transferred at a transfer station to a support material, such as a sheet of paper. Subsequently, the developed image is fixed by any suitable means to provide a permanent image or reproduction.

Conventionally, image forming devices, such as laser printers and facsimile machines, employ an exposure system, a photoreceptor and a developer. An electrostatic latent image is formed on the photoreceptor by exposing it to laser light and the latent image is subsequently developed into a visible toner powder image. The visible toner image is then transferred from the photoreceptor onto a physical medium, such as a sheet of paper. The photoreceptor is typically a portable drum having a photosensitive surface. Processing stations are sequentially disposed around the photoreceptor and are fixed in position with respect to each other and to the photoreceptor. Such processing stations generally include a charging station, an exposure station, a developing station and a transfer station.

The charging station imparts an electrical charge onto the photosensitive surface of the photoreceptor and typically includes a corona charging wire. The electrical charge enables the toner image to be formed on the photoreceptor. The exposure station stations forms an electrostatic latent image on the photosensitive surface of the photoreceptor through an imaging light source (laser beam). The developing station develops the latent image on the photosensitive surface of the photoreceptor into the visible toner image and typically includes a supply of tone, such as powder, and a developing roller that transfers the toner powder onto the photoreceptor. The transfer station transfers the visible toner powder from the photoreceptor to the paper sheet, generally by use of a transfer wire.

In addition, a fixing device is provided which fixes or stabilizes the visible image on the paper sheet and enables the paper sheet to be handled without destroying the image. The fixing device typically works on the principle of heat and pressure rollers. A residual toner removing device, such as a cleaning blade, is also provided for removing toner that remains on the photoreceptor after the toner image has been transferred to the paper sheet. A discharge of pre-exposure station, such as an erase light, may also be provided to remove any residual electrical charge on the photoreceptor after the image has been transferred to the paper sheet. The discharge station is typically positioned between the toner removing device and the corona charging station.

During the development of such images, the toner portion of the developer mixture is depleted. In order to maintain the requisite portion of toner, fresh toner must be resupplied periodically. The means for supplying fresh toner must operate smoothly and consistently and must be reliable as well as leak-free for an electrophotographic machine or the like to operate properly.

Various types of toner resupply systems are known to the prior art as, for example, the container or cartridge types shown by U.S. Pat. Nos. 3,337,072 (Del Vecchio et al.), 4,091,765 (Lowthorp et al.), 5,118,013 (Mutou et al.) and 5,235,389 (Kikuchi et al.). All four of these prior art arrangements teach a toner supply cartridge consisting of relatively rotatable inner and outer concentric cylinders, each with a toner dispensing opening or openings. The supply of fresh toner is held in the inner cylinder, and by rotating the inner cylinder relative to the outer cylinder, the discharge openings of each cylinder are brought into alignment thereby allowing for the dispensing of toner. To close the dispensing openings, the inner cylinder is again rotated relative to the outer cylinder such that the inner cylinder toner dispensing openings are closed by the inner surface of the outer cylinder.

One disadvantage of these concentric cylinder-type designs is that a deformation of either the inner or outer cylinder will make it impossible to achieve a desired smooth, rotational sliding motion between the outer surface of the inner cylinder and inner surface of the outer cylinder. Rather, such deformation will cause these portions of the cylinders to rub together. This interference between the cylinders will lead to abrading. As these portions of the cylinders become worn and damaged, the cylinders will no longer be able to rotate properly relative to each other thereby causing the improper dispensing of toner or lack thereof and/or leakage. Further, with the concentric cylinder design, large surface areas of the cylinders have the potential of interfering with each other due to deformation at any given time. The more surface contact between the cylinders, the greater the likelihood that a deformation in either cylinder will impede the proper functioning of the cartridge.

Similarly, U.S. Pat. No. 5,030,997 (Michlin et al.) teaches a toner supply and dispensing cartridge consisting of a cylinder having a plurality of toner supply ports spaced along its length and parallel to its longitudinal axis. Disposed within the interior of and extending the length of the cylinder is a multi-cup scoop, which rotates causing the dispensing of toner as the cylinder rotates. Optionally, a stationary sleeve may be disposed around the rotatable cylinder. The sleeve is provided with a plurality of openings corresponding to the location of the toner supply ports of the cylinder so that as the cylinder rotates, the ports periodically come into alignment with the openings thereby permitting the discharge of toner. The same problems encountered with the concentric cylinder-type designs wherein the cylinders rotate relative to one another would also be encountered in the design taught by Michlin et al. wherein only the inner cylinder rotates while the outer sleeve remains stationary.

U.S. Pat. No. 4,688,926 (Manno) teaches a reproduction machine having a rotatable toner supply cartridge. The toner supply cartridge consists of a hollow tube or cylinder having a plurality of toner discharge ports extending along its longitudinal axis and a means for controlling the timing and dumping of the toner from the toner discharge ports into a developer housing.

In one embodiment of the toner supply cartridge, the cylinder is provided with a plurality of spaced slot-like toner discharge ports in its surface. A rotatable, elongated toner dumping or ejecting rod is provided to control the timing and dumping of the toner from the toner discharge ports into the developer housing. This rotatable ejecting rod consists of a series of flats or recesses and is held in tight contact with the exterior surface of the cylinder extending the length of the cylinder opposite the row of toner discharge ports. As the cylinder rotates so that the toner discharge ports face the developer housing, the ejecting rod is rapidly rotated from a position where the flats are facing the toner dispensing ports and picking up toner to a position where the flats are facing toward the interior of the developer station. As a result, the toner deposited on the flats is ejected into the developer housing.

In an alternative embodiment, the cylinder has a plurality of spaced circular discharge ports in its surface extending along its longitudinal axis and is provided with an elongated rigid strip-like slide plate. This slide plate has a series of toner discharge ports capable of mating with those of the cylinder and is sealably held in position on the exterior of the cylinder opposite the row of toner discharge ports. The reciprocal sliding movement of the slide plate, in a longitudinal direction along the exterior surface of the cylinder, causes the opening and closing of the toner discharge ports thereby controlling the dispensing of toner.

The problem with this type toner resupply cartridge, is that it is mechanically complex and somewhat cumbersome. This design contains several moving parts, which increases the opportunity for malfunction and necessitates careful quality control to protect against or minimize product failure. The added quality control needed can be overly time consuming as well as add to the expense of production.

Thus, it is desirable to provide a toner supply cartridge that is simply constructed from a minimum number of parts, easily operated, leak-free and operational with minimal cylinder degradation.

The invention disclosed herein has accomplished this by providing a toner supply cartridge having a single hollow cylinder fitted with an internal shutter member. The design allows for excellent slidability between the shutter member and the interior surface of the cylinder of the toner supply cartridge thereby providing smooth, reliable, consistent and leak-free operation of the toner supply cartridge.

SUMMARY OF THE INVENTION

The toner dispensing apparatus of the present invention is used for supplying fresh particulate matter in electrophotographic machines and the like. The toner dispensing apparatus comprises a generally cylindrical container for storing a quantity of particulate matter such as toner, developer, and the like.

The cylindrical container is provided with at least one end aperture and at least one toner discharge opening formed therein. A first closure is detachably, rotatably and sealingly secured to the cylindrical container for closing the end aperture. In a preferred embodiment, the first closure includes a grasping means for facilitating rotation of the first closure. In another preferred embodiment, the cylindrical container is provided with a second end aperture and a second closure that is removably and sealingly secured to the cylindrical container for closing the second aperture.

A shutter member extends from the first closure for selectively opening and closing the toner discharge opening of the cylindrical container when the first closure is rotated. A sheet of foamed material carried by the shutter provides a seal against leakage of toner from the toner dispensing apparatus. In a preferred embodiment, the shutter member extends from the first closure into the cylindrical container adjacent the inner surface of the cylindrical container.

The toner dispensing apparatus is also provided with an aligning means. In a preferred embodiment, the means for aligning the toner dispensing apparatus includes at least one positioning rib extending outward from and along the length of the cylindrical container generally opposite the toner discharge opening.

The toner dispensing apparatus is also provided with a wire agitator within the cylindrical container, that is connected to gear means associated with the first closure and that is rotated by external drive means. The wire agitator prevents toner clumping while the toner is being dispensed.

Operationally, the toner dispensing apparatus of the invention is installed into an electrophotographic type reproduction machine, laser printer or similar device in a generally horizontal position with the toner discharge opening generally facing downward. Toner is dispensed from the cylindrical container by rotating the first closure such that the shutter member uncovers the toner discharge opening. Toner exits the toner discharge opening under the force of gravity. When the desired amount of toner has been dispensed, the first closure is again rotated such that the shutter member covers the toner discharge opening.

DESCRIPTION OF THE PRESENTLY PREFERRED EMBODIMENT(S)

Figure 2:
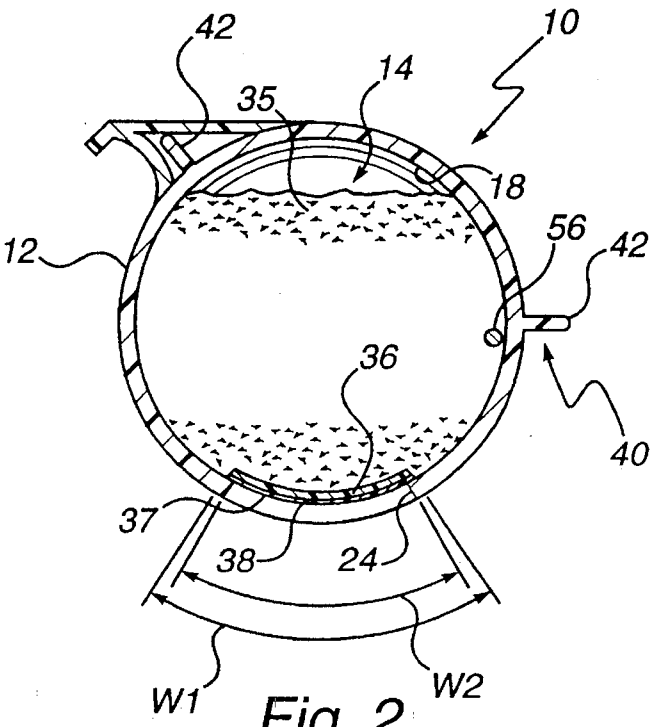
FIG. 2 is a cross-sectional view of the cartridge of FIG. 1 taken along the line 2—2.

The toner dispensing apparatus of the present invention controllably resupplies fresh particulate matter, such as toner, developer, and the like, within electrophotographic type reproduction machines, laser printers, and the like.

A preferred embodiment of the toner dispensing apparatus 10 of the invention is illustrated in FIGS. 1–10 The toner dispensing apparatus 10 comprises a generally cylindrical container 12 having a cavity 14 for storing a quantity of particulate matter 35 (FIG. 2) such as toner, developer, and the like. The cylindrical container includes a length indicated by the dimension line 16 (FIG. 5), a generally cylindrical inner surface 18 and a generally cylindrical outer surface 20. The cylindrical container 12 also is provided with at least one end aperture 22 (FIG. 5) and at least one toner discharge opening 24 that communicates with the cavity 14 of the cylindrical container 12. In a preferred embodiment, the cylindrical container 12 is provided with one toner discharge opening 24 that is longer in length than it is wide and is located in a longitudinal direction substantially at a center of the cylinder 12.

A detachable, rotatable first closure 26 is provided which closes the first end aperture 22 in a toner-tight manner. In a preferred embodiment, the first closure 26 includes a grasping means 28, such as a flange, lever, handle, knob, or the like, for facilitating rotation of the first closure 26. The grasping means 28 includes a grooved lever 30 (FIG. 3) extending from the first closure 26. Alternatively, the grasping means 28 may be provided with ribs, ridges, abrasive strip(s) or the like.

The cylindrical container 12 of the toner dispensing apparatus 10 is provided with a second end aperture 32 (FIG. 5) and a second closure 34 that is detachably secured to the cylindrical container 12 for closing the second aperture 32 in a toner-tight manner. Particulate matter 35 (FIG. 2), such as toner, can be introduced into the cylindrical container 12 via either of the end aperture 22 or 32.

Figure 1:
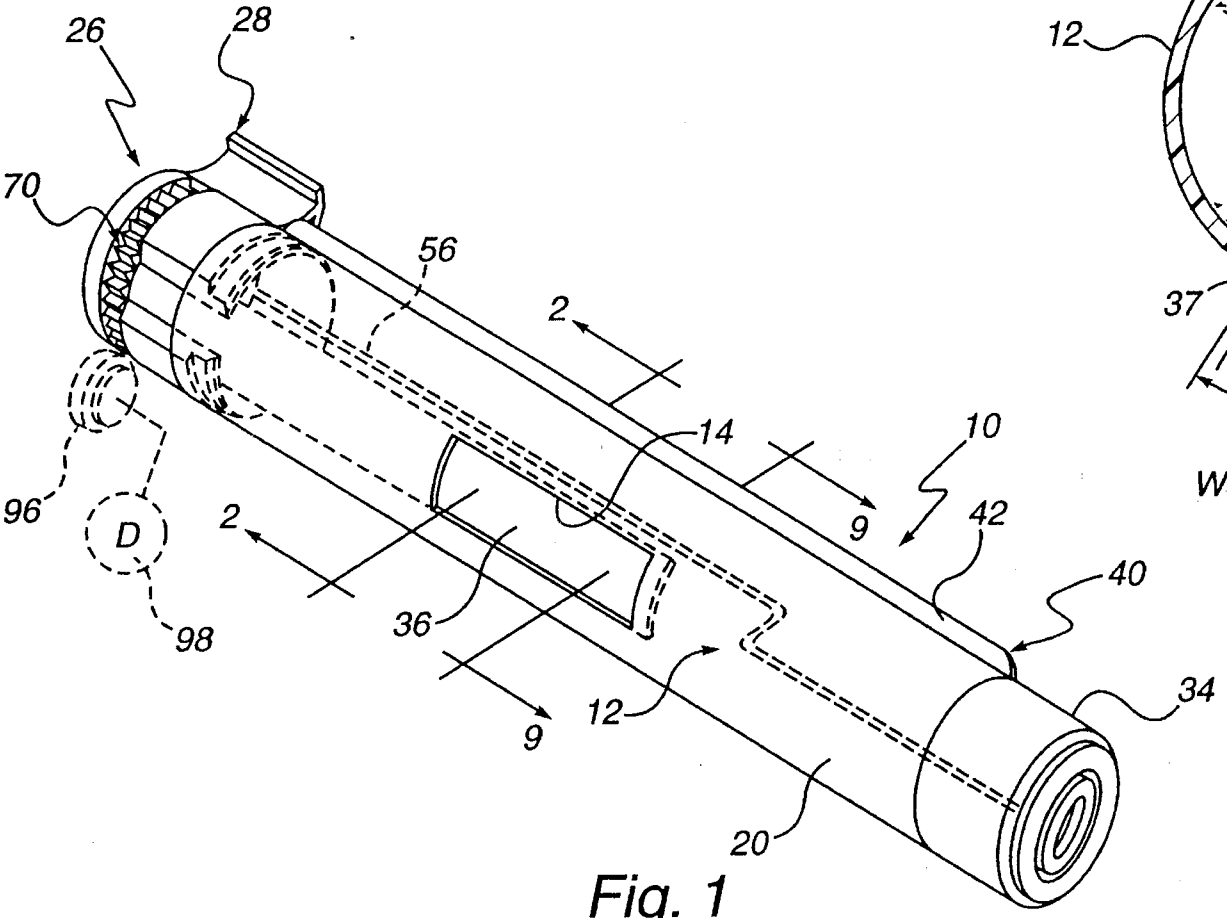
FIG. 1 is a perspective view of a preferred embodiment of the toner supply cartridge of the invention showing the shutter member in the closed position.
Figure 4:
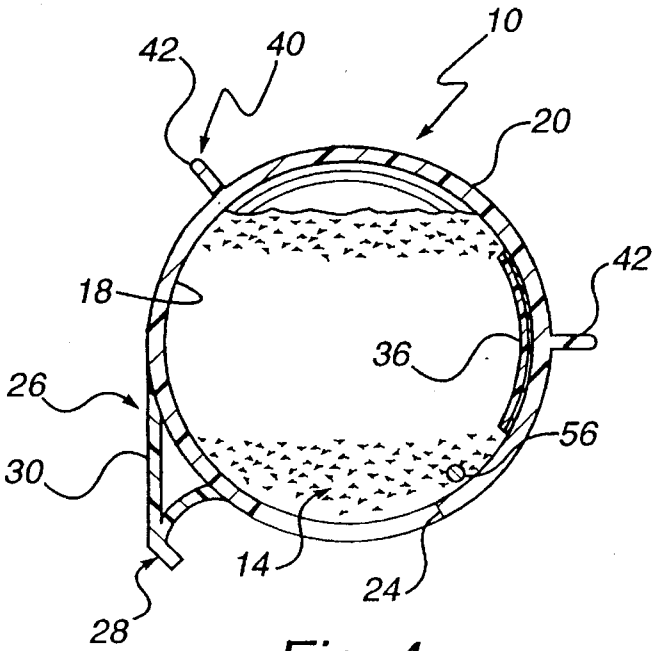
FIG. 4 is a cross sectional view of the cartridge in FIG. 3 taken along line 4—4.
Figure 3:
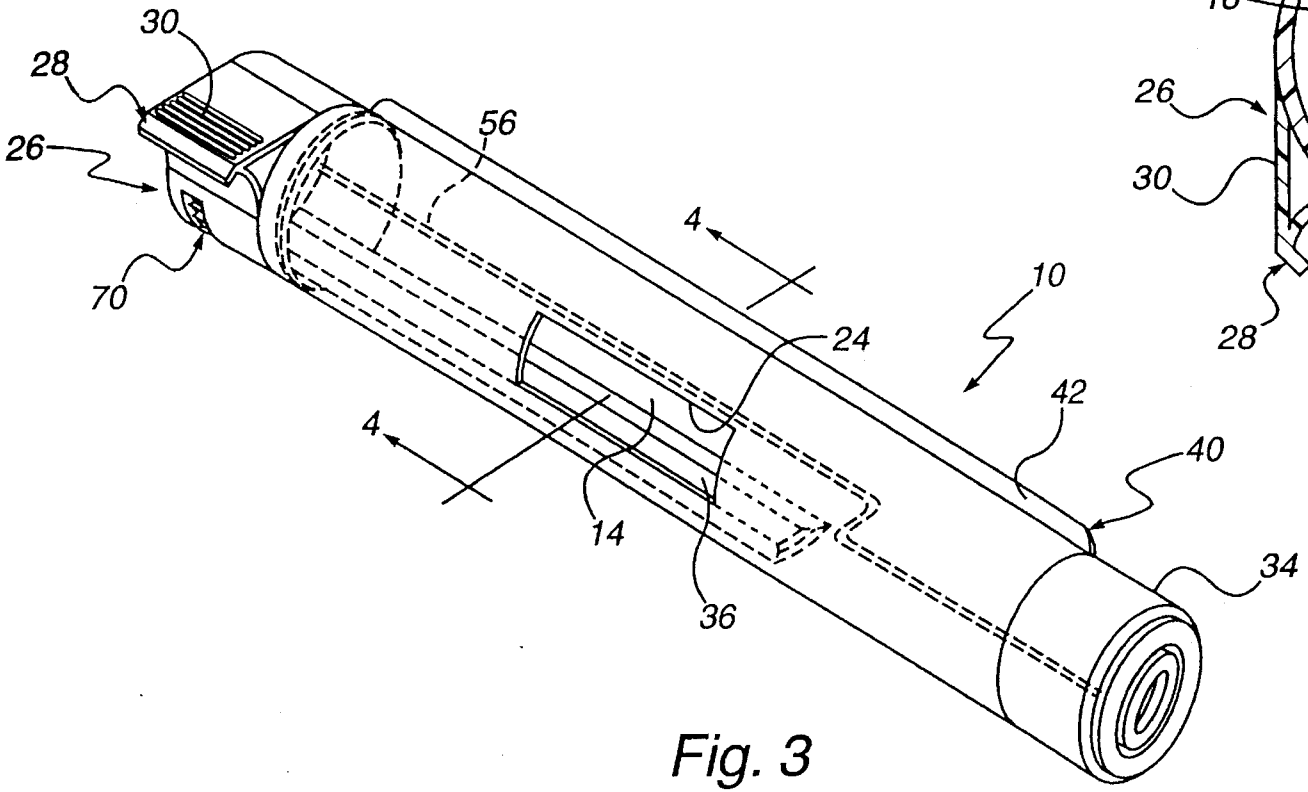
FIG. 3 is a perspective view of a preferred embodiment of the toner supply cartridge showing the shutter member in the open position allowing for the dispensing of toner.

A shutter member 36 extends from the first closure 26 for selectively opening and closing the toner discharge opening 24 of the cylindrical container 12 when the first closure 26 is rotated. In a preferred embodiment, the shutter member 36 extends from the first closure 26, into the cylindrical container 12. The shutter member 36 is provided with a seal member 37 preferably formed from a foamed plastic material. The seal member 37 has a curved outer surface 38 that conforms to the generally cylindrical inner surface 18 of the cylindrical container 12 so as to allow the curved outer surface 38 of the shutter member 36, which faces the inner surface 18 of the cylindrical container 12, to slidably rotate with the rotation of the first closure 26. The seal member 37 also protects against inadvertent spillage of the toner 35. The shutter member 36 operates from the interior of the cylindrical container 12 to open the toner discharge opening 24 as shown in FIGS. 3 and 4, and to close the toner discharge opening 24 as shown in FIGS. 1 and 2. As shown in FIG. 2, the shutter member 36 has a width indicated by the dimension line W1 which is greater than the width of the toner discharge opening 24 indicated by the dimension line W2. The curved outer surface 38 of the seal member 37 The curved shape and greater width of the shutter member 36 allows the shutter member 36 to smoothly and controllably open and close the toner discharge opening 24 as the shutter member 36 slidably and circumferentially rotates along the inner surface 18 of the cylindrical container 12 with the rotation of the first closure 26.

The cylindrical container 12 of the toner dispensing apparatus 10 also is provided with an aligning means 40, such as ribs, notches, pegs, grooves, or the like, for proper operational positioning of the toner container 10 within electrophotographic type reproduction machines, or the like. In a preferred embodiment, the alignment means 40 for aligning the toner dispensing apparatus 10 includes at least one and preferably two positioning ribs 42 extending outward from and along the length 16 of the cylindrical container 12 and which are spaced-apart from the toner discharge opening 24.

The toner dispensing apparatus 10 of the invention is installed into an electrophotographic type reproduction machine, laser printer or similar device in a generally horizontal position with the toner discharge opening 24 generally facing downward, as illustrated in FIGS. 2 and 4. Toner is dispensed from the cylindrical container 12 by rotating the first closure 26 from the position illustrated in FIG. 2 to the position illustrated in FIG. 4, such that the shutter member 36 uncovers the toner discharge opening 24. An agitator element 56 shown in phantom outline in FIGS. 1 and 3, is rotatable by gear means 70 carried by the first closure 26. A pinion gear 96 (FIG. 1) driven by a suitable drive D, drives the gear means 70 forcibly rotates the agitator element 56 within the cylindrical container 12 thereby preventing toner clumping while the toner is being discharged from the cylindrical container 12 through the toner discharge opening 24. When the desired amount of toner has been dispensed, the first closure 26 is again rotated to the position illustrated in FIG. 2, that is, such that the shutter member 36 covers the toner discharge opening 24.

Figure 5:
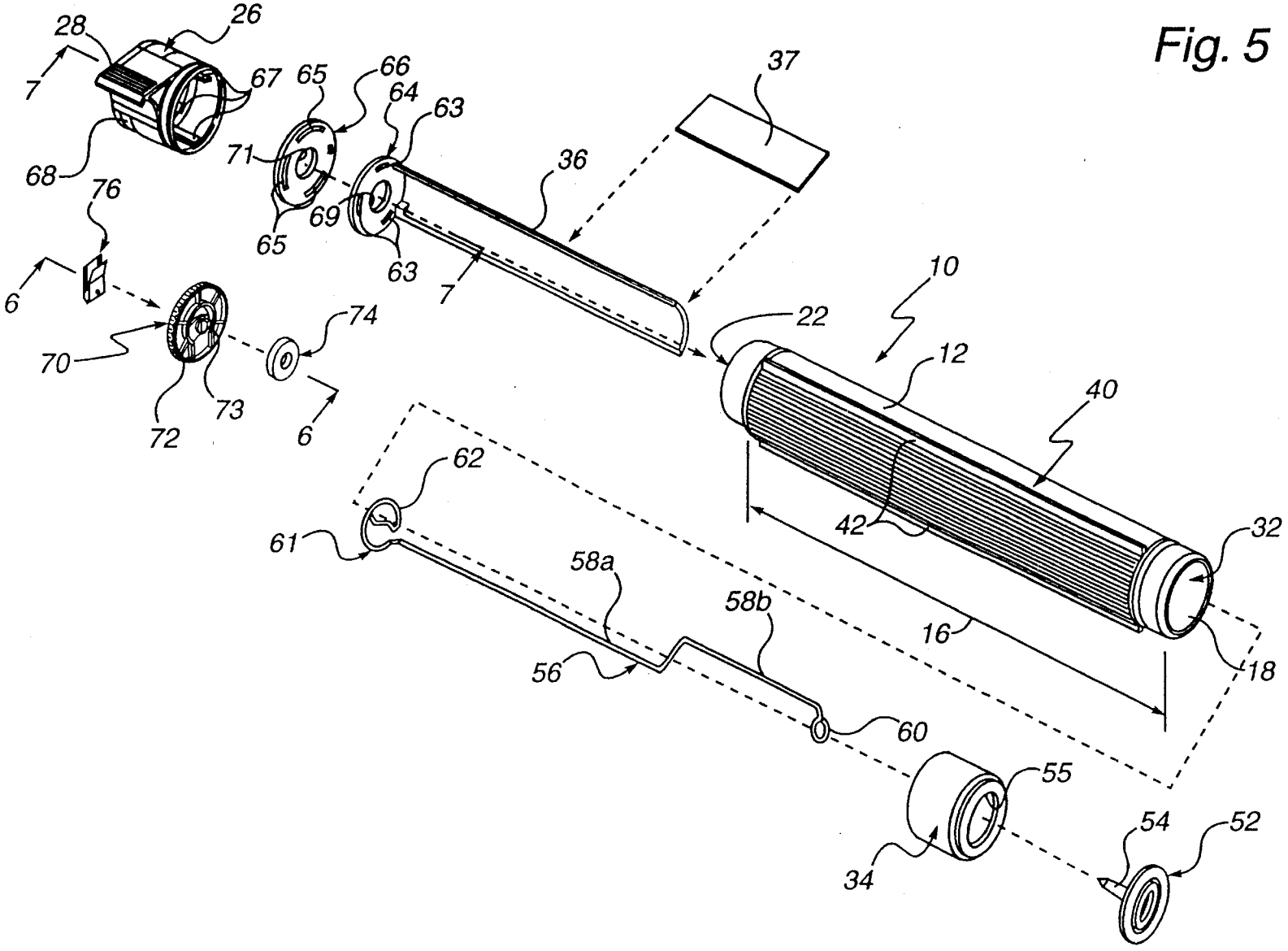
FIG. 5 is isometric view in exploded form, illustrating the present toner dispensing apparatus.

Referring to FIG. 5, the cylindrical container 12 has the first and second end apertures 22, 32 adapted to receive the first and second closures 26, 34. The container 12 includes the alignment means 40 for aligning the toner dispensing apparatus 10 comprising at least one and preferably two positioning ribs 42 extending outward from and along the length 16 of the cylindrical container 12 and which are spaced-apart from the toner discharge opening 24 (not visible in FIG. 5). The cylindrical container 12 includes the cylindrical inner surface 18.

The apparatus 10 further incorporates a plug element 52 having a pin-like projection 54 extending toward the second closure 34. The second closure 34 has an opening 55 for receiving the plug 52. An agitator element 56 also is provided having laterally offset portions **58*a*, 58*b*. A loop 60 is formed at the free end of the offset portion 58*b*. When the plug is introduced into the opening 55 of the second closure 34, the pin-like projection thereof enters the loop 60 and supports the loop 60 during rotation of the agitator element 56. A second loop 61 is formed at the free end of the offset portion 58*a* and includes a longitudinally offset pin segment 62. The agitator element 56 is forcibly rotated within the cylindrical container 12 and prevents toner clumping while the toner is being discharged from the cylindrical container 12**.

The shutter member 36 is provided with an end plate 64 adapted to engage a gasket 66 that is introduced into the first closure 26. The end plate 64 and the gasket 66 present arcuate openings 63, 65, respectively. The arcuate openings 63, 65 are positioned to receive prongs or tabs 67 projecting from the interior of the first closure 26 thereby connecting the shutter member 36 to the first closure 26 for rotation thereby.

The gear assembly 82 (FIG. 6) comprised of gear means 70, a gasket 74 and a leaf spring member 76. The gear means 70 has a central hub 72 presenting a slot 73. The gasket 74 is received over the hub 72 prior to placement of the gear assembly 82 into the slot 68 (FIGS. 5, 7 and 8) of the first closure 26. The opposite side of the gear means 70 receives the leaf spring member 76.

Figure 6:
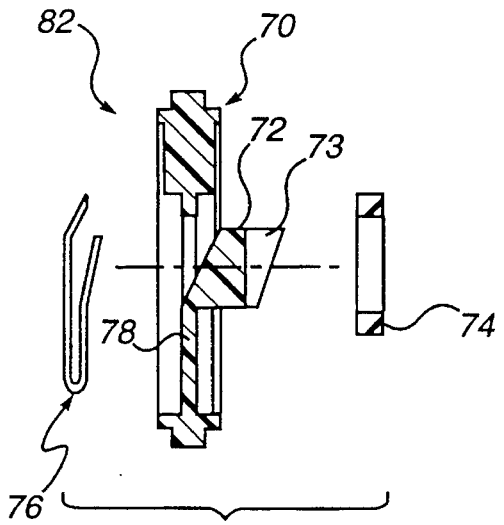
FIG. 6 is a cross-sectional view taken along the line 6—6 of FIG. 5.
Figure 7:
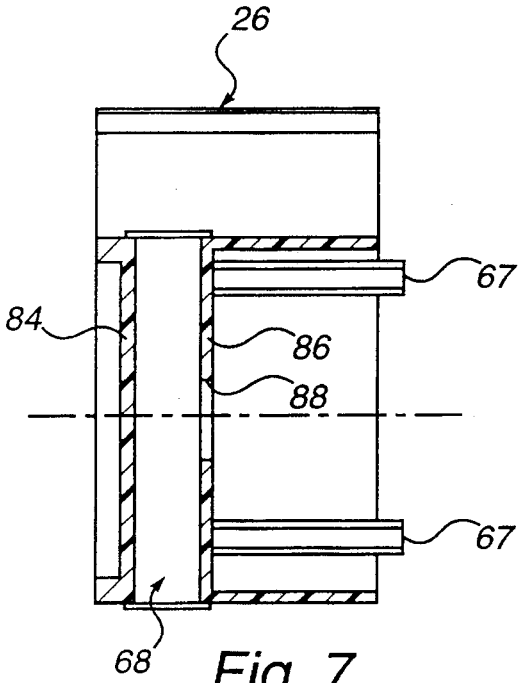
FIG. 7 is a cross-sectional view taken along the line 7—7 FIG. 5.
Figure 8:
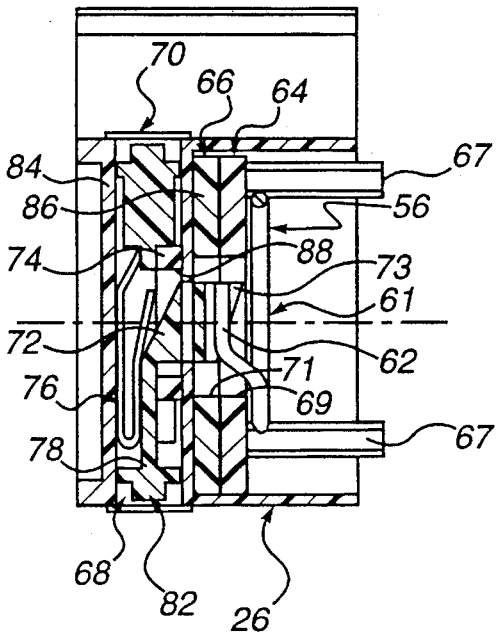
FIG. 8 is a cross-sectional view, similar to FIG. 7, but illustrating the first closure of FIG. 5 in assembled form.

As best shown in FIG. 6, the hub 72 of the gear means 70 is formed at the end of a flexible arm portion 78 which is flexed to the left of FIG. 8 when the gear assembly 82 is introduced into the slot 68 (FIGS. 7 and 8). As shown in FIG. 6, the assembly 82 is comprised of the gear means 70, the gasket 74 and the leaf spring member 76. As can be seen in FIG. 7, the slot 68 is defined between confronting rear and front walls 84, 86. The front wall 86 includes a central opening 88. As shown in FIG. 8, the gear assembly 82 is retained in the slot 68 by having the hub 72 project through the central opening 88 in the front wall 86, and by having the leaf spring 76 urge the gear means 70 toward the front wall 86. The second loop 61 of the agitator element 56 abuts the end plate 64 of the shutter 36 while the pin segment 62 projects through the central openings 69, 71 of the end plate 64 and the gasket 66 and is received in a hub slot 73 presented by the hub 72.

Figure 9:
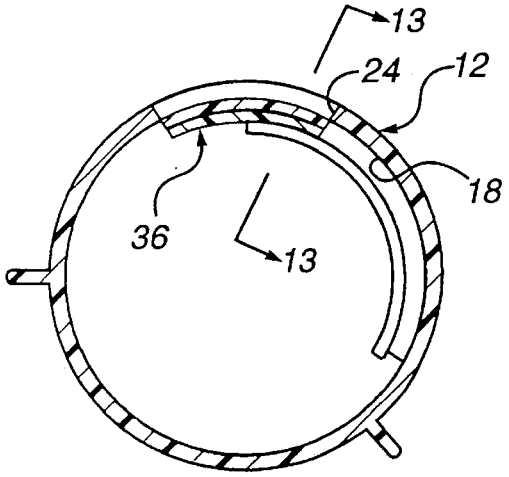
FIG. 9 is a cross-sectional view taken along the line 9—9 of FIG. 1.
Figure 10:
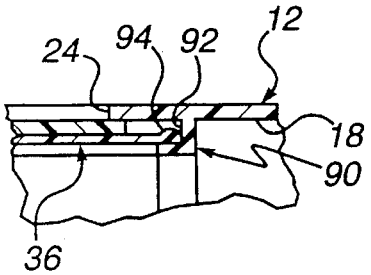
FIG. 10 is a cross-sectional view taken along the line 10—10 of FIG. 9.

Referring to FIGS. 9 and 10, the cylindrical container 12 is provided with guide means 90 for guiding the end of the shutter 36 during rotation thereof within the cylindrical container 12. The guide means 90 is provided on the cylindrical inner surface 18 of the cylindrical container 12. As seen in FIG. 10, the guide means 90 is longitudinally spaced-apart from the toner discharge opening 24 and, as seen in FIG. 9, subtends an angle of about 118 angular degrees. The guide means 90 has an angle-shaped transverse profile as can be seen in FIG. 10, and cooperates with the cylindrical inner surface 18 of the cylindrical container 12 to present a slot 92 receiving and guiding the end 94 of the shutter 36.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. Apparatus for dispensing toner comprising:

a generally cylindrical container for containing a quantity of toner, said container having a length, and including at least one end aperture and at least one toner discharge opening formed therein;

a first closure detachably, rotatably and sealingly secured to said cylindrical container for closing said end aperture;

a shutter member extending from said first closure for selectively opening and closing said toner discharge opening of said cylindrical container when said first closure is rotated;

a seal member overlying said shutter member in and beyond said toner discharge opening; and means for aligning said dispensing apparatus.

2. The dispensing apparatus of claim 1 wherein said generally cylindrical container includes a generally cylindrical inner surface; and said shutter member extends from said first closure into said cylindrical container adjacent said inner surface of said cylindrical container for selectively opening and closing said toner discharge opening of said cylindrical container when said first closure is rotated, said shutter member including a curved outer surface conforming to the generally cylindrical inner surface of said cylindrical container.

3. The dispensing apparatus of claim 1 wherein said toner discharge opening includes a width, and said shutter member includes a width that is greater than said width of said toner discharge opening.

4. The dispensing apparatus of claim 1 further comprising:

a second end aperture; and a second closure removably and sealingly secured to said cylindrical container for closing said second aperture.

5. Apparatus for dispensing toner comprising:

a generally cylindrical container for containing a quantity of toner, said container having a length, and including at least one end aperture and at least one toner discharge opening formed therein;

a first closure detachably, rotatably and sealingly secured to said cylindrical container for closing said end aperture;

a shutter member presenting an end portion and extending from said first closure for selectively opening and closing said toner discharge opening of said cylindrical container when said first closure is rotated;

guide means within said cylindrical container and engaging said end portion for guiding said shutter member during rotation thereof; and means for aligning said dispensing apparatus.

6. Apparatus for dispensing toner comprising:

a generally cylindrical container for containing a quantity of toner, said container having a length, and including at least one end aperture and at least one toner discharge opening formed therein;

a first closure detachably, rotatably and sealingly secured to said cylindrical container for closing said end aperture;

a shutter member extending from said first closure for selectively opening and closing said toner discharge opening of said cylindrical container when said first closure is rotated;

agitator means disposed within said cylindrical container for preventing toner clumping;

means for rotating said agitator means;

means for aligning said dispensing apparatus.

7. The dispensing apparatus of claim 6 wherein said means for rotating said agitator means comprises gear means associated with said first closure.

8. Apparatus for dispensing toner comprising;

a generally cylindrical container for containing a quantity of toner, said container having a length, and including at least one end aperture and at least one toner discharge opening formed therein;

a first closure detachably, rotatably and sealingly secured to said cylindrical container for closing said end aperture;

a shutter member extending from said first closure for selectively opening and closing said toner discharge opening of said cylindrical container when said first closure is rotated;

said first closure having grasping means including a grooved lever extending from said first closure for facilitating rotation of said first closure; and means for aligning said dispensing apparatus.

9. Apparatus for dispensing toner comprising:

a generally cylindrical container for containing a quantity of toner, said container having a length, and including at least one end aperture and at least one toner discharge opening formed therein;

a first closure detachably, rotatably and sealingly secured to said cylindrical container for closing said end aperture;

a shutter member extending from said first closure for selectively opening and closing said toner discharge opening of said cylindrical container when said first closure is rotated; and means for aligning said dispensing apparatus, said aligning means including at least one positioning rib extending outward from and along the length of said cylindrical container generally opposite said toner discharge opening.

* * * * *